US006280228B1

(12) United States Patent
Maciejewski et al.

(10) Patent No.: US 6,280,228 B1
(45) Date of Patent: Aug. 28, 2001

(54) SUBMARINE PERISCOPE EYE BOX CONNECTOR, MAST CONNECTOR, AND CONNECTOR GUIDE FOR FACILITATING BLIND INTERCONNECTION

(75) Inventors: Wendell C. Maciejewski, Wakefield; Riad Sayegh, West Kingston, both of RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/448,404

(22) Filed: Nov. 22, 1999

(51) Int. Cl.[7] ..... H01R 13/629
(52) U.S. Cl. ..... 439/374
(58) Field of Search ..... 439/374, 375, 439/377, 701, 680

(56) References Cited

U.S. PATENT DOCUMENTS 4,905,938 * 3/1990 Braccio et al. ..... 439/374
5,697,805 * 12/1997 Orstad et al. ..... 439/374
5,921,802 * 7/1999 Reiswig et al. ..... 439/374

FOREIGN PATENT DOCUMENTS 88 03715 * 5/1988 (WO) ..... 439/374

* cited by examiner

*Primary Examiner*—Hien Vu
(74) *Attorney, Agent, or Firm*—Michael J. McGowan; Michael F. Oglo; Prithvi C. Lall

(57) ABSTRACT

In combination, a male, multiple connection-type, electrical connector, a female, multiple connection-type, electrical connector, and a connector guide for facilitating blind interconnection of the male and female connectors. The male electrical connector comprises a submarine periscope eye box mating end electrical connector. The female electrical connector comprises a submarine periscope mast mating end electrical connector. The connector guide comprises a wall adapted to slidingly engage outside surfaces of the female connector, and an outwardly flared skirt extending from an edge of the guide wall opposed to the eye box mating end. The connector guide is slidable onto the female connector and the male connector is slidable into the connector guide and is guided thereinto by the connector guide skirt, and is guided by the connector guide into the female connector, such that the eye box connector elements engage the mast connector elements.

4 Claims, 4 Drawing Sheets

SUBMARINE PERISCOPE EYE BOX CONNECTOR, MAST CONNECTOR, AND CONNECTOR GUIDE FOR FACILITATING BLIND INTERCONNECTION

STATEMENT OF GOVERNMENT INTEREST

The invention described herein may be manufactured and used by and for the Government of the United States of America for Governmental purposes without the payment of any royalties thereon or therefor.

BACKGROUND OF THE INVENTION (1) Field of the Invention

The invention relates to electrical connectors and is directed more particularly to, in combination, a submarine periscope eye box connector, a mast connector, and a connector guide for facilitating blind interconnections thereof.

(2) Description of the Prior Art

Herein a vocabulary convention will be employed which applies the term "male connector" to a first type of mating, multiple connection, electrical connector (e.g., connectors 22, FIG. 1) whose wall 34 (best shown in FIG. 4) is inserted in a second-type of connector (e.g., connectors 26, FIG. 2) whose wall 40 (best shown in FIG. 4) receives the wall of the first-type connector. The term "female connector" is applied to this second-type connector. Note that this runs contrary to the extant situation at the level of the individual connector elements, where the individual connector elements of the first-type connector are pin receptors 36 (shown in FIG. 1) which suggest a female-type structure, and where the individual connector elements of the second-type connector are pins 42 (shown in FIG.2).

In the assembly of submarine periscopes, the eye box is connected to the periscope mast such that electrical connectors are joined inside a barrel, out of view of assembly personnel. In FIG. 1, there is shown an eye box mating end 20 having male electrical connectors 22 mounted thereon. In FIG. 2, there is shown a periscope mast mating end 24 having female electrical connectors 26 thereon. In assembly of a periscope, it is necessary that the connectors 22, 26 be brought into proper interengagement with each other. Given that perfect alignment is seldom realized, the male connectors 22 are mounted in a manner permitting some movement of the connectors 22 widthwise so as to accommodate to slight misalignments.

As is shown in FIG. 3, each of the male electrical connectors 22 comprises a plate 28 mounted on the mating end 20 of the eye box. The plate 28 is provided with slightly oversized holes 30 through which extend headed fasteners 32. A wall 34 upstands from the plate 28 and surrounds eye box, pin receptor-type, connector elements 36 (FIG. 1). Similarly, each of the female electrical connectors 26 comprises a plate 38 (FIG. 3) mounted on the mating end 24 of the mast. The plate 38 is immovably affixed to the mast mating end 24. A wall 40 depends from the plate 38 and surrounds mast, pin-type, connector elements 42 (FIG. 2). The mast connector wall 40 is configured to slidingly receive the eye box connector wall 34 therein. In the event of a slight misalignment, the male connector 22 can move laterally into alignment with the female connector 26.

At times, the connectors 22 and 26 are not in proper alignment and male connector 22 fails to move into alignment with female connector 26, resulting in a misconnection or no connection. When this occurs, the remedy is not simply moving the eye box and mast apart and starting again. Because other connections, not pertinent here, have been made, disassembly of the joined eye box and mast is a laborious and time-consuming procedure, in practice calling for shipment of the periscope to a particular facility for disassembly. At times the mis-match of connectors goes unnoticed until a test reveals a problem.

Accordingly, there is a need for a connector guide which will serve to insure alignment of the connectors and, thereby, proper interengagements of the connectors.

SUMMARY OF THE INVENTION

An object of the invention is, therefore, to provide, in combination, a periscope eye box connector, mast connector, and guide for facilitating accurate and reliable blind interconnections of the eye box and mast connectors.

With the above and other objects in view, as will hereinafter appear, a feature of the present invention is the provision of, in combination, a male electrical connector, a female electrical connector, and a connector guide for facilitating blind interconnection of the male and female connectors. The male electrical connector comprises a submarine periscope eye box mating end electrical connector comprising a first plate mounted on the mating end of the eye box and movable in a plane of the eye box mounting end, and a first male wall upstanding from the first plate and surrounding eye box connector elements. The female electrical connector comprises a submarine periscope mast mating end electrical connector, comprising a second plate mounted on the mating end of the mast, and a second wall depending from the second plate and surrounding mast connector elements, the second wall being configured to slidingly receive the first wall therein. The connector guide comprises a wall adapted to slidingly engage outside surfaces of the second wall, an outwardly flared skirt extending from an edge of the guide wall opposed to the eye box mating end, and an inwardly extending lip or collar disposed on inside surfaces of the guide wall, the collar being adapted to abutingly engage an edge of the second wall. The connector guide is slidable onto the second wall until the connector guide collar engages the edge of the second wall, and the first wall is slidable into the connector guide and is guided thereinto by the connector guide skirt, and is guided by the connector guide into the second wall, such that the eye box connector elements engage the mast connector elements.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent, wherein corresponding reference characters indicate corresponding parts throughout the several views of the drawings and wherein.

DESCRIPTION OF THE PREFERRED EMBODIMENT

As noted earlier in this specification, the term "male connector" as used in this specification and the appendent claims refers to a component of a two-part, multiple connection assembly whose wall is slidingly inserted inside the wall of the other component, which is referred to as the "female connector" (this despite the extant situation at the level of individual electrical connector elements of these connectors implying contrary connotations).

Figure 4:
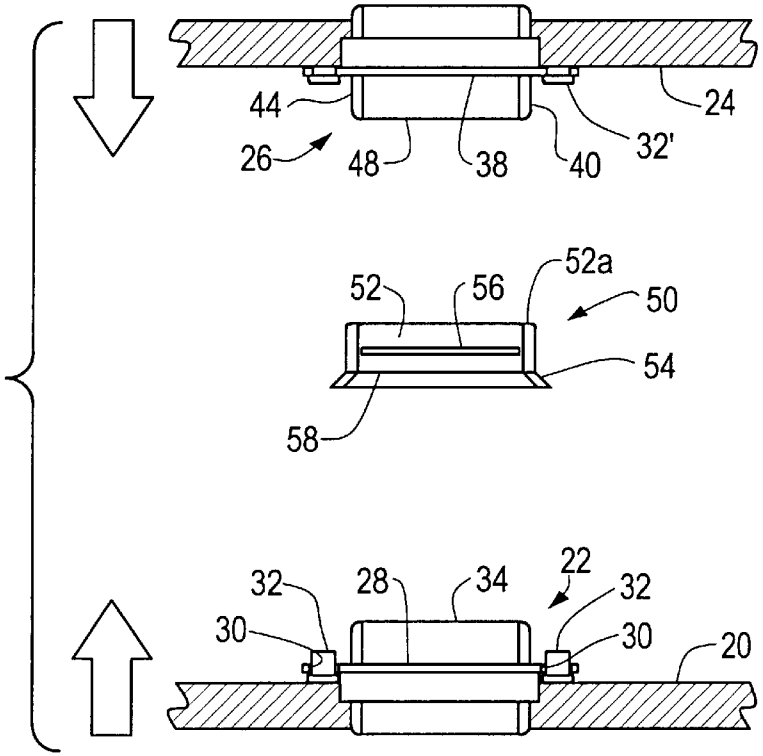
FIG. 4 is similar to FIG. 3, but shows in combination with the electrical connectors, a connector guide illustrative of an embodiment of the invention.
Figure 3:
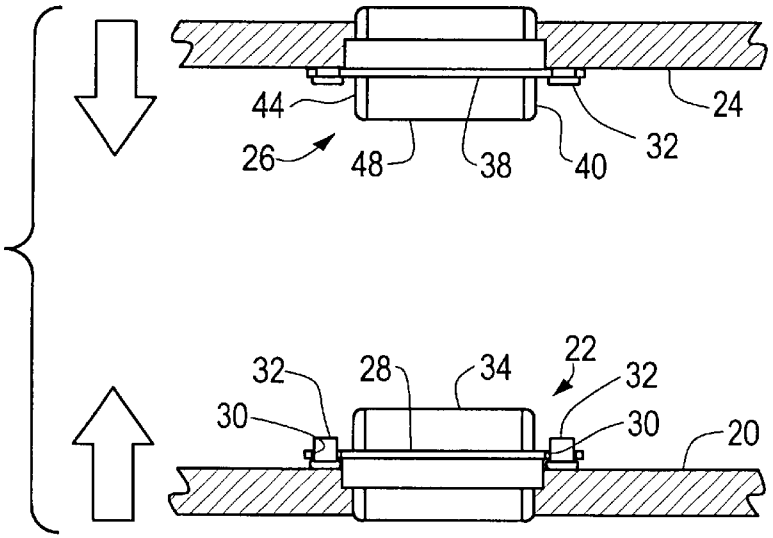
FIG. 3 PRIOR ART
FIG. 3 is a diagrammatic sectional illustration of an eye box electrical connector mounted on the mating end of the eye box, as shown in FIG. 1, in position opposed to a mast electrical connector mounted on the mating end of the mast, as shown in FIG. 2, the electrical connectors being illustrated in position for joining together.

Referring to FIG. 4, it will be seen that the illustrative invention includes the aforementioned eye box mating end male electrical connectors or connector subassemblies 22, and mast mating end female electrical connectors or connector subassemblies 26, in combination with a connector guide 50. Connectors 22 and 26 are subassemblies of a standard commerically available "D-type", two-part, connector assembly, so named from the "D" shape of the male and female walls 34 and 40 (shown in FIGS. 4–6) of the subassemblies. Subassemblies 22 and 26 are referred to in this specification and the appended claims as "male connector" or "male connectors," and "female connector" or "female connectors," respectively.

Figure 5:
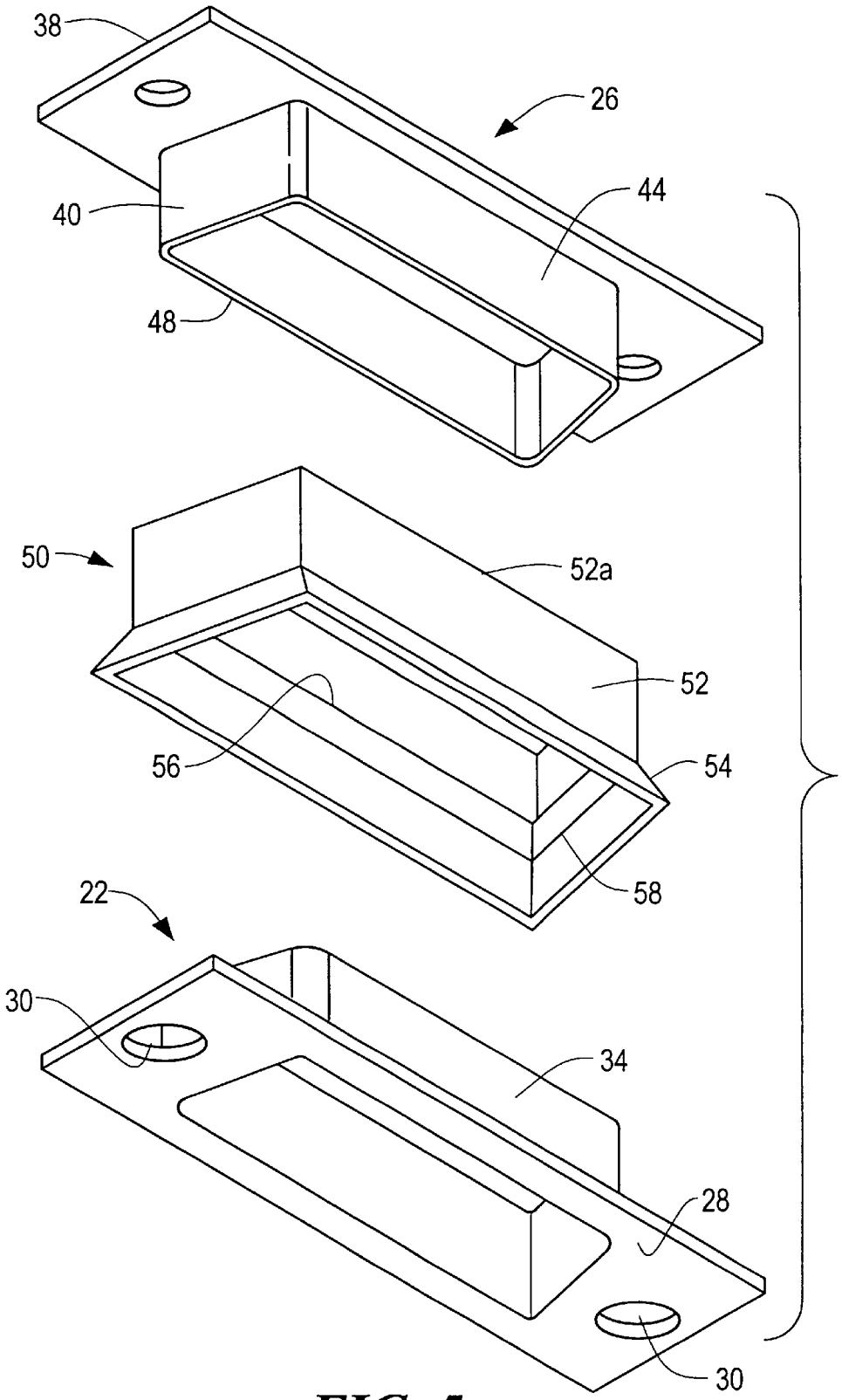
FIG. 5 is an exploded view of the opposed electrical connector shells and the connector guide disposed therebetween.

The guide 50 includes a wall 52 having a terminal edge 52*a,* FIGS. 4 and 5, configured to slip over and slidingly engage the outer surface 44 of female connector wall 40. The guide 50 fits over connector 26 in a snug fashion, such that once fitted onto connector 26, guide 50 remains in place through friction fit.

The guide 50 further includes an outwardly flared skirt 54 extending from an edge 58 of guide wall 52 opposed to eye box mating end 20.

The guide 50 still further includes an inwardly-extending lip or collar 56 protruding from wall 52. The wall 52, skirt 54 and collar 56 preferably are molded as a single unitary device, which is of a material providing a degree of flexibility and resiliency such as a plastic material.

Figure 2:
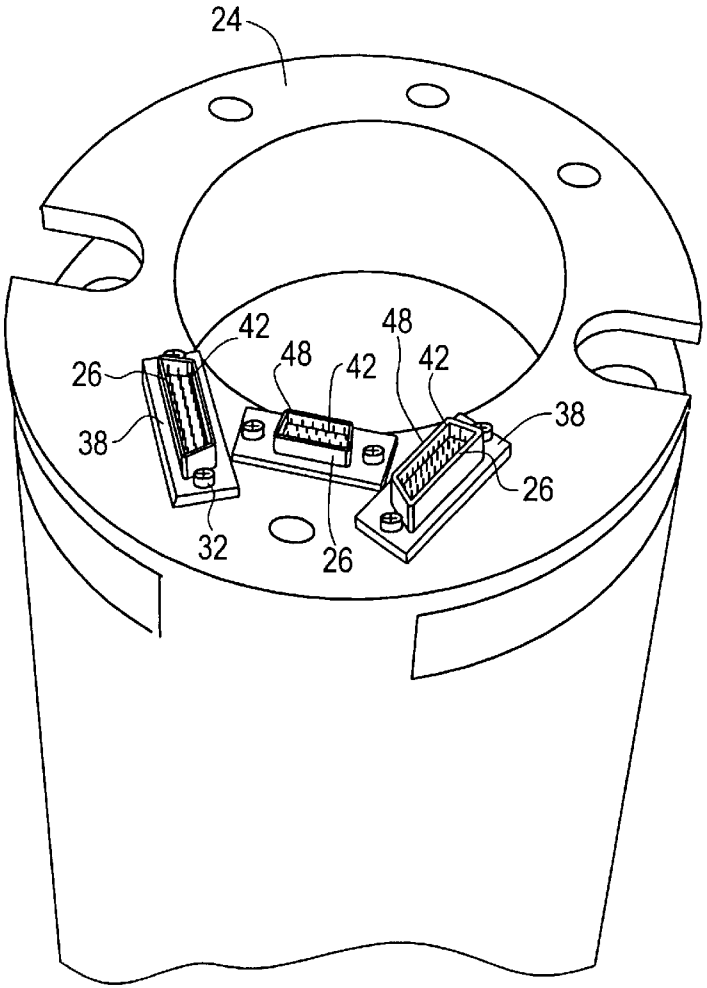
FIG. 2 PRIOR ART
FIG. 2 is a perspective view of a prior art submarine periscope mating end of a mast.
Figure 1:
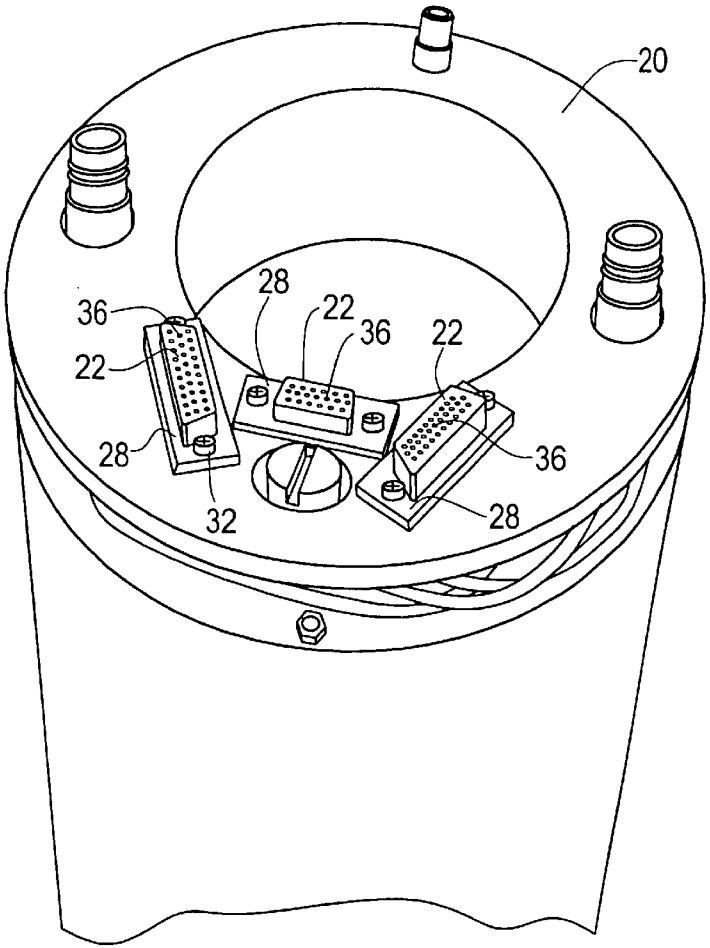
FIG. 1 PRIOR ART
FIG. 1 is a perspective view of a prior art submarine periscope mating end of an eye box.
Figure 6:
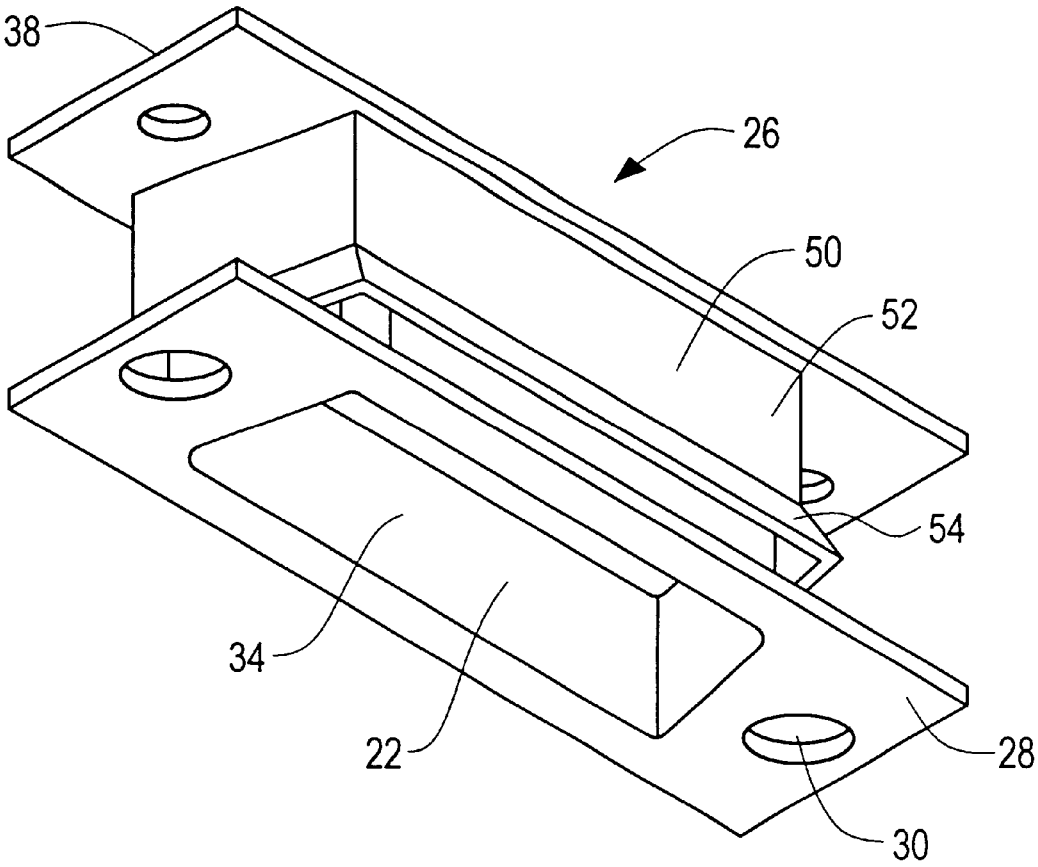
FIG. 6 is a perspective view of the connectors and connector guide of FIGS. 4 and 5 joined together.

In use, male connector plates 28 (FIGS. 1, 4–6) of electrical connectors 22 are attached to eye box mating end 20 in a known fashion which allows the connector to laterally "float", by means of suitable fasteners 32 (FIGS. 1 and 4) extending through oversized holes 30 being (FIGS. 4–6). More specifically, to the extent that oversized holes 30 are larger than the diameter of the stem of fasteners 32, plate 28 is unrestrained against lateral motion in the plane of eye box mating end 20. Male connectors 22 are thusly provided as "finger touch loose" within the range of lateral movement allowed by oversized holes 30. However, female electrical connectors 26 are immovably affixed to mast mating end 24 by conventional fasteners 32' extending through holes (unnumbered) in female connector plates 38 (FIGS. 2–6).

As part of assembling the eye box to the mast, an artisan presses the unflared edge of each of the guides 50 onto a female connector 26 until the guide's connector collar 56 engages an edge 48 of female connector wall 40. The guide 50 is then released, and remains held in place by the resilient restraining force provided by the molded plastic unit.

The mast mating end 24, before being connected to the eye box mating end 20, is disposed in a mast barrel (not shown) and is about fourteen inches from the lower end of the barrel. The eye box mating end is slid into the barrel and mates with the mast mating end in a blind location, that is, at a location not susceptible to viewing by the artisan.

As the male connector 22 approaches the female connector 26, the male connector wall 34 approaches and engages connector skirt 54 which guides male connector 22 into alignment with female connector 26, the male connector 22 being adapted to laterally shift its positions slightly due to the relative motion allowed by the arrangement of fasteners 32 and oversized holes 30. Inasmuch as guide collar 56 covers the female connector wall edge 48, there is no edge-to-edge contact between the connector walls 34, 40. Upon further translatory motion of eye box mating end 20 toward mast mating end 24 the male connector wall 34 (FIGS. 4–6) is guided into the female connector wall 40 (FIGS. 4 and 5), with a correctly aligned relation of the connector' respective individual connector elements (i.e., pin receptors 36, FIG. 1 and pins 42, FIG. 2) to interengage.

As alluded to earlier, there is a need for connector guide 50 to have a degree of flexibility and resiliency in connection with the requirement that it be pressable onto female connector wall 40 and thereafter be resiliently retained thereon. On the other hand, it must be sufficiently hard and stiff to cause male connectors 20 to laterally shift upon the latter's lateral engagement with the flared skirt 54 of guide 50. It has been found that a plastic material having a durometer measured hardness in the range 40–60 on the Shore A scale provides the desired combination of characteristics. Any known thermosetting or cold curing plastic material known in the art providing this combination of characteristics may be employed.

There is thus provided, in combination, a periscope eye box connector, mast connector, and guide for facilitating accurate and reliable blind interconnection of the eye box and mast connectors. This improves quality control in the assembly of submarine periscopes, and essentially eliminates costly and time consuming remedial work at remote specialized repair facilities due to misconnection in the mating of connectors 22 and 26.

Upon servicing of the periscope, if any damage to, or wear of, the connector guide 50 is noted, the guide 50 can be discarded and replaced. The cost of a connector guide is negligible.

It will be understood that many additional changes in the details, materials, steps and arrangement of parts, which have been herein described and illustrated in order to explain the nature of the invention, may be made by those skilled in the art within the principles and scope of the invention as expressed in the appended claims.

What is claimed is:

1. A connector assembly for provision of electrical connections between an eye box and a mast of a periscope, said connector assembly comprising:

a male electrical connector comprising a submarine periscope eye box mating end electrical connector, and further comprising a first plate mounted on said mating end of said eye box and movable on said eye box mounting end along a plane thereof, and a first male wall upstanding from said first plate and surrounding eye box connector elements;

a female electrical connector comprising a submarine periscope mast mating end electrical connector having a substantially D-shaped body, and further comprising a second plate immovably mounted on said mating end of said mast, and a second female wall depending from said second plate and surrounding mast connector elements, said second wall being configured to slidingly receive said first male wall therein; and a connector guide comprising a guide wall having a substantially D-shaped body adapted to slidingly engage outside surfaces of said second female wall, an outwardly flared skirt extending from an edge of said guide wall opposed to said eye box mating end, and an inwardly extending collar disposed on inside surfaces of said guide wall, said collar being adapted to abutingly engage an edge surface of said second wall said connector guide being made of a plastics material exhibiting a degree of flexibility and resilience;

wherein said connector guide is slidable onto said second female wall until said connector guide collar engages and covers said edge surface of said second wall, and said first male wall is slidable into said connector guide and is guided thereinto by said connector guide skirt, and is guided by said connector guide collar past said second wall edge and into said second wall, such that said eye box connector elements engage said mast connector elements.

2. The combination in accordance with claim 1 wherein the plastics material has a durometer measured harness in a range of 40–60 on a Shore A scale.

3. A connector guide for facilitating blind interconnection of a male electrical connector and a female electrical connector each having a substantially D-shaped body, said connector guide comprising:

a guide wall having a substantially D- shaped body with a substantially continuous first terminal edge for confronting the female connector and a second terminal edge for confronting the male electrical connector, said guide wall being adapted to slip over and slidingly engage outside surfaces of the female electrical connector;

an outwardly flared skirt extending from the second terminal edge of said guide wall, and an inwardly extending collar disposed on inside surfaces of said guide wall, said collar being adapted to abutingly engage a free edge of the female connector, and said outwardly flared skirt is adapted to receive the male connector which is guided thereby and by said collar into an aligned relationship with the female connector such that upon further translatory movement of the male connector connector elements in the female connector engage connector elements in the male connector and said connector guide being made of a plastics material exhibiting a degree of flexibility and resilience.

4. The connector guide in accordance with claim 3 wherein the plastics material has a durometer measured hardness in a range of 40–60 on a Shore A scale.

* * * * *